US010734748B2

(12) United States Patent
Miyamura et al.

(10) Patent No.: US 10,734,748 B2
(45) Date of Patent: Aug. 4, 2020

(54) CONNECTOR

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); Toyota Jidosha Kabushiki Kaisha, Toyota-shi, Aichi (JP)

(72) Inventors: Tetsuya Miyamura, Yokkaichi (JP); Masaaki Tabata, Yokkaichi (JP); Yasuo Omori, Yokkaichi (JP); Kimiyasu Okumura, Yokkaichi (JP); Hiroshi Kobayashi, Okazaki (JP); Ryutaro Yamazaki, Toyota (JP)

(73) Assignees: AutoNetworks Technologies, Ltd. (JP); Sumitomo Wiring Systems, Ltd. (JP); Sumitomo Electric Industries, Ltd. (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 16/476,698

(22) PCT Filed: Dec. 25, 2017

(86) PCT No.: PCT/JP2017/046342
§ 371 (c)(1),
(2) Date: Jul. 9, 2019

(87) PCT Pub. No.: WO2018/131446
PCT Pub. Date: Jul. 19, 2018

(65) Prior Publication Data

US 2019/0326702 A1 Oct. 24, 2019

(30) Foreign Application Priority Data

Jan. 13, 2017 (JP) ..... 2017-003971

(51) Int. Cl.
*H01R 24/00* (2011.01)
*H01R 13/506* (2006.01)
(Continued)

(52) U.S. Cl.
CPC ..... *H01R 13/506* (2013.01); *H01R 13/627* (2013.01); *H01R 13/631* (2013.01); *H01R 13/641* (2013.01)

(58) Field of Classification Search
CPC .. H01R 13/506; H01R 13/641; H01R 13/631; H01R 13/627; H01R 13/64; H01R 24/542; H01R 13/26; H01R 9/0518; H01P 5/026
(Continued)

(56) References Cited

U.S. PATENT DOCUMENTS 3,292,117 A * 12/1966 Bryant ..... H01R 24/542 333/260
7,374,460 B1 * 5/2008 Hariharesan ..... H01R 13/26 439/679
(Continued)

FOREIGN PATENT DOCUMENTS

JP 63-292584 11/1988
JP 5-11361 2/1993
(Continued)

OTHER PUBLICATIONS

International Search Report dated Mar. 6, 2018.

*Primary Examiner* — Jean F Duverne
(74) *Attorney, Agent, or Firm* — Gerald E. Hespos; Michael J. Porco; Matthew T. Hespos

(57) ABSTRACT

A male internal conductor and a female internal conductor are reliably connected. When female-side and male-side dielectric bodies (16, 41) approach each other in an opposing positional relationship, a tab (32) of a male internal con-
(Continued)

ductor (30) is inserted into a female-side dielectric body (41) and connected to a female internal conductor (42). The female-side dielectric body (41) has an opposing surface (41S) facing the male-side dielectric body (16) and formed with a female-side positioning portion (47). The male-side dielectric body (16) has an opposing surface (22S) facing the female-side dielectric body (41) and formed with a male-side positioning portion (25) which is disposed ahead of the tab (32) and which can be fitted with the female-side positioning portion (47) in a state where the tab (32) is not in contact with the female-side dielectric body (41).

6 Claims, 12 Drawing Sheets

(51) Int. Cl.
*H01R 13/627* (2006.01)
*H01R 13/631* (2006.01)
*H01R 13/641* (2006.01)

(58) Field of Classification Search
USPC ..... 439/626
See application file for complete search history.

(56) References Cited

U.S. PATENT DOCUMENTS

2003/0224656 A1* 12/2003 Yoshida ..... H01R 9/0518
439/578
2014/0134878 A1* 5/2014 Van Swearingen ..... H01P 5/026
439/607.01

FOREIGN PATENT DOCUMENTS

JP 2009-26590 2/2009
JP 2012-129103 7/2012

* cited by examiner

CONNECTOR

BACKGROUND

Field of the Invention

The present invention relates to a connector.

Related Art

Japanese Unexamined Patent Application Publication No. 2012-129103 discloses a connector in which a male internal conductor is attached to a male-side dielectric body, a female internal conductor is attached to a female-side dielectric body, and both the female-side and male-side dielectric bodies are fitted together, whereby the male internal conductor and the female internal conductor are connected.

In this type of connector, a tapered surface is formed in the front surface of the female-side dielectric body to guide a tab provided in a distal end of the male internal conductor into the female-side dielectric body. However, in the case of a miniaturized connector, since a distal end portion of the tab of the male internal conductor has an elongated and pointed shape, there is a concern that the tab may pierce the tapered surface. When the tab pierces the tapered surface, the female and male internal conductors cannot be connected to each other.

The present invention has been completed based on the above situation and aims to reliably connect a male internal conductor and a female internal conductor.

SUMMARY

The present invention is a connector including:

a male-side dielectric body;

a male internal conductor provided in the male-side dielectric body and having a tab formed in a front end portion thereof;

a female-side dielectric body disposed so as to face the male-side dielectric body; and a female internal conductor provided in the female-side dielectric body.

When the male-side dielectric body and the female-side dielectric body approach each other in an opposing positional relationship, the tab is inserted into the female-side dielectric body and connected to the female internal conductor.

The female-side dielectric body has an opposing surface facing the male-side dielectric body and formed with a female-side positioning portion.

The male-side dielectric body has an opposing surface facing the female-side dielectric body and formed with a male-side positioning portion which is disposed ahead of the tab and which can be fitted with the female-side positioning portion in a state where tab is not in contact with the female-side dielectric body.

When the male-side dielectric body and the female-side dielectric body are caused to approach each other, the male-side positioning portion and the female-side positioning portion are fitted together, and thereby the male-side dielectric body and the tab are positioned relative to the female-side dielectric body and the female internal conductor, with the result that the tab is connected to the female internal conductor without interfering with the female-side dielectric body.

In the present invention, the male-side dielectric body may include a holding member for holding a region behind the tab of the male internal conductor, and a slide member which is slidable with respect to the holding member in a front-rear direction between a protective position and a retracted position behind the protective position. The female-side positioning portion may be formed on an opposing surface of the female-side dielectric body facing the slide member, and the male-side positioning portion may be formed on an opposing surface of the slide member facing the female-side dielectric body.

According to this configuration, when the male-side dielectric body and the female-side dielectric body are caused to approach each other while the slide member is in the protective position, the male-side positioning portion and the female-side positioning portion are fitted together, and thereby the male-side dielectric body and the tab are positioned relative to the female-side dielectric body and the female internal conductor. In this state, when the male-side dielectric body is caused to further approach the female-side dielectric body, the holding member and the male internal conductor approach the female-side dielectric body while being displaced relative to the slide member, and the tab is connected to the female internal conductor without interfering with the female-side dielectric body.

In the present invention, one of the male-side positioning portion and the female-side positioning portion may have a protruding shape, the other positioning portion may have a recessed shape, and at least one of the positioning portion having a protruding shape and the positioning portion having a recessed shape may include a tapered surface.

According to this configuration, it is possible to fit the protruding positioning portion and the recessed positioning portion smoothly.

In the present invention, the male-side dielectric body may be accommodated in a male-side housing having a hood portion surrounding the tab, the male-side positioning portion may have a protruding shape, and the female-side positioning portion may have a recessed shape.

According to this configuration, the male-side positioning portion having a protruding shape can be protected from interference of foreign matter by being accommodated in the hood portion.

DETAILED DESCRIPTION

Figure 9:
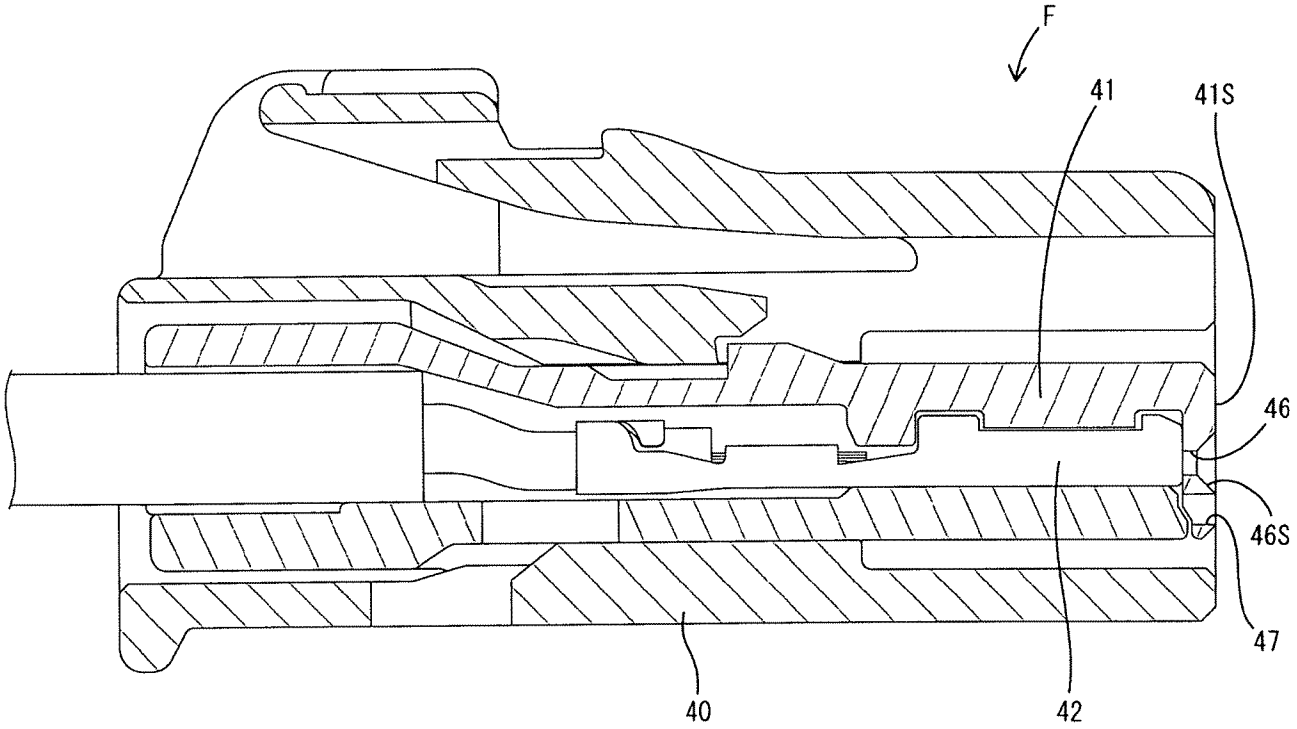
FIG. 9 is a cross-sectional view taken along line Y-Y in FIG. 8.

Hereinafter, a first embodiment in which the present invention is embodied will be described with reference to FIGS. 1 to 12. In the following description, as for a front-rear direction of a male-side connector M, the left side in FIGS. 1, 3 to 6, and 10 to 12 is defined as a front side. As for a front-rear direction of a female-side connector F, the right side in FIGS. 7 and 9 is defined as a front side. As for the up-down direction, the directions shown in FIGS. 1 to 12 are defined as an upside and a downside as they are.

The connector of the present embodiment includes the male-side connector M and the female-side connector F. The male-side connector M and the female-side connector F are fitted together by approaching each other with their front surfaces facing each other, whereby a male internal conductor 30 of a male-side conductive path 27 attached to the male-side connector M and a female internal conductor 42 of a female-side conductive path 43 attached to the female-side connector F are connected.

Figure 1:
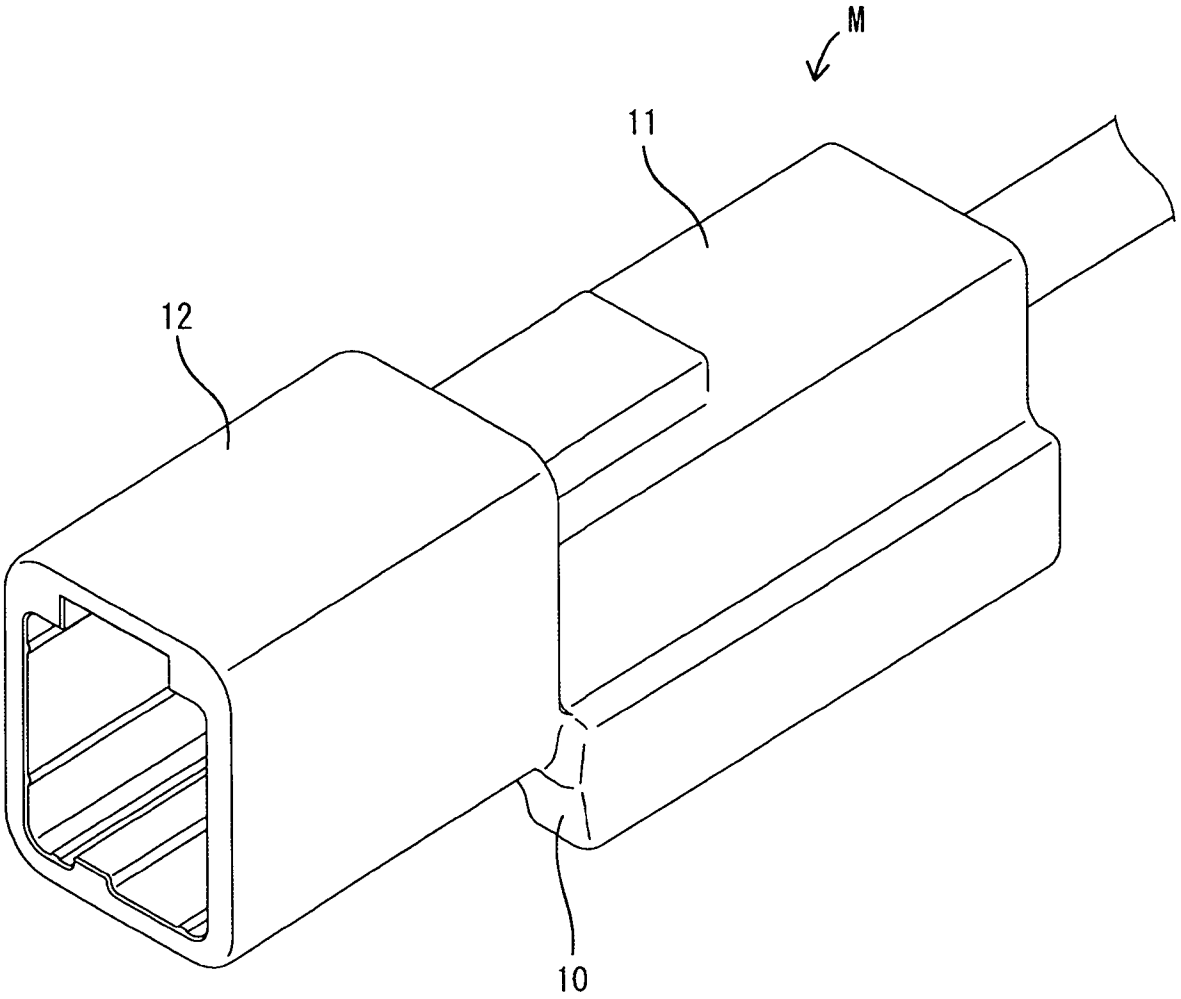
FIG. 1 is a perspective view of a male-side connector of a first embodiment.
Figure 2:
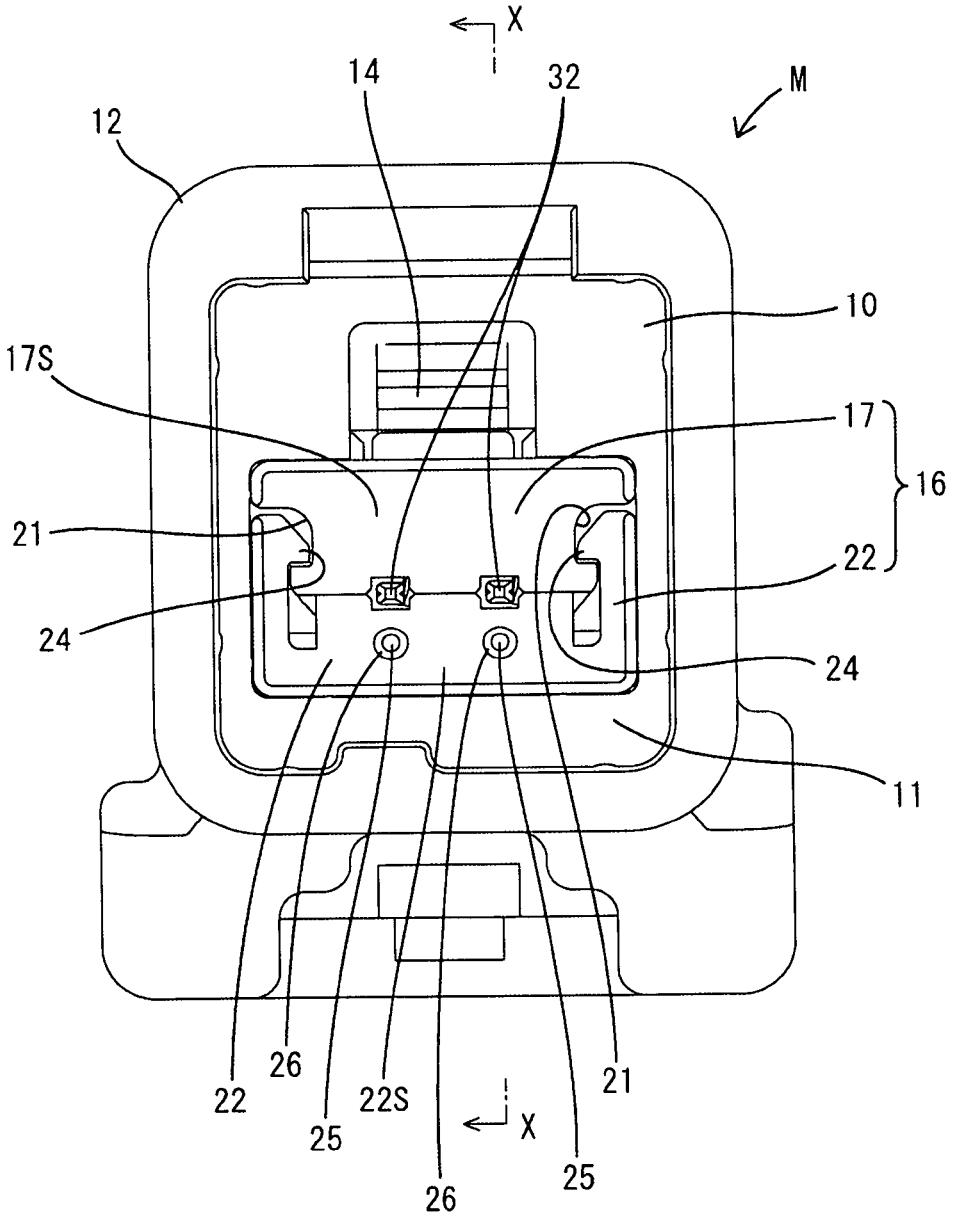
FIG. 2 is a front view of the male-side connector.
Figure 3:
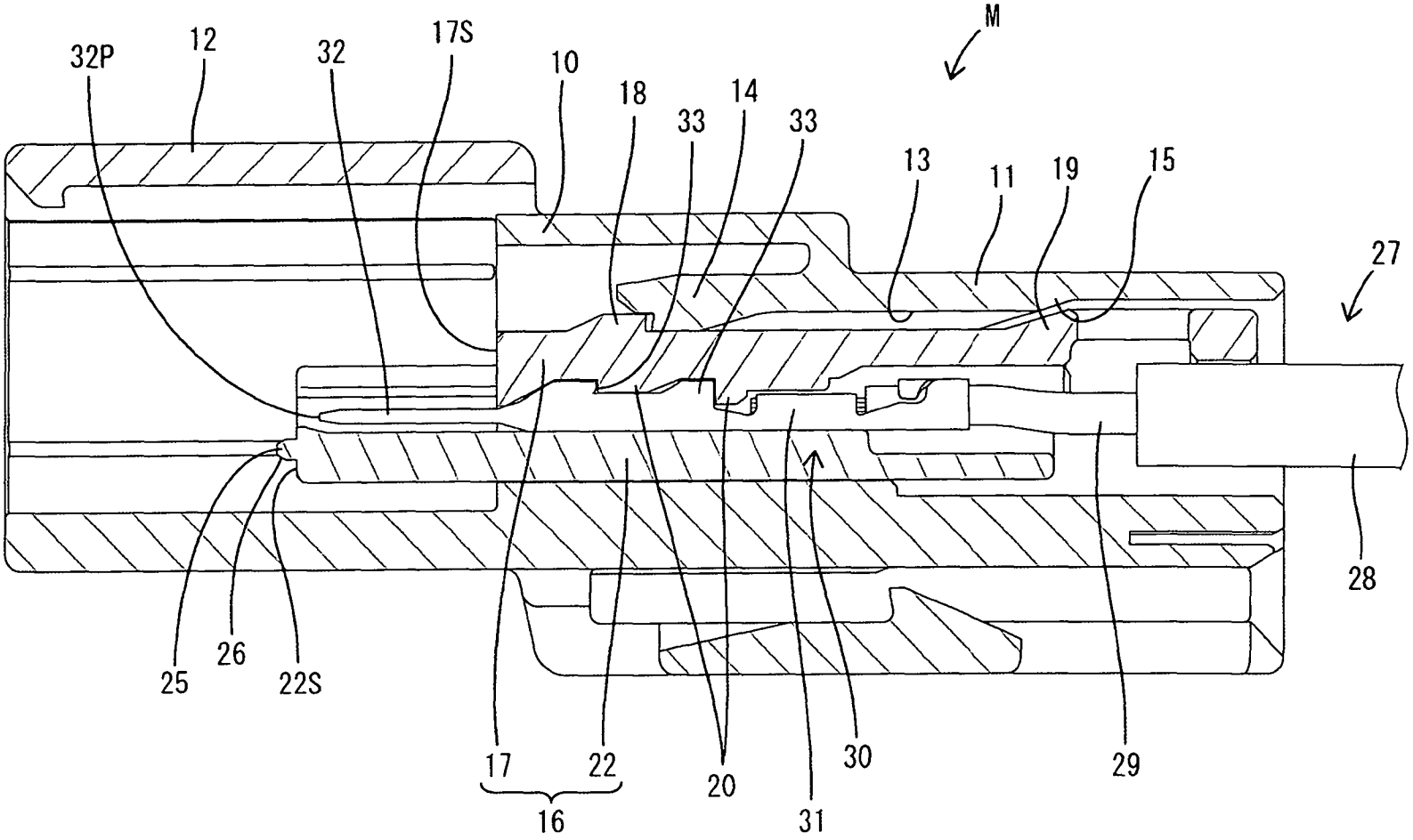
FIG. 3 is a cross-sectional view taken along line X-X in FIG. 2.
Figure 4:
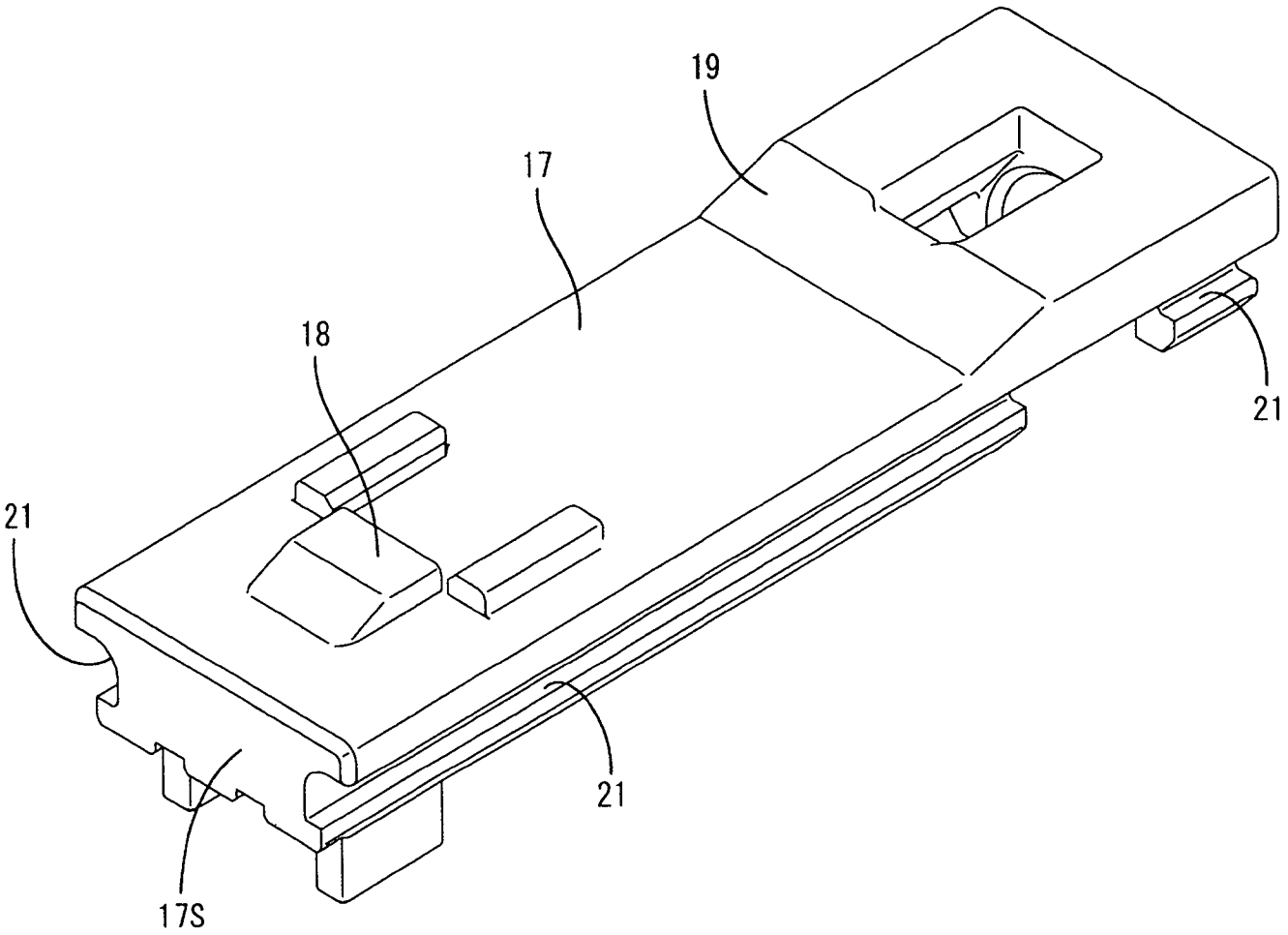
FIG. 4 is a perspective view of a holding member.
Figure 5:
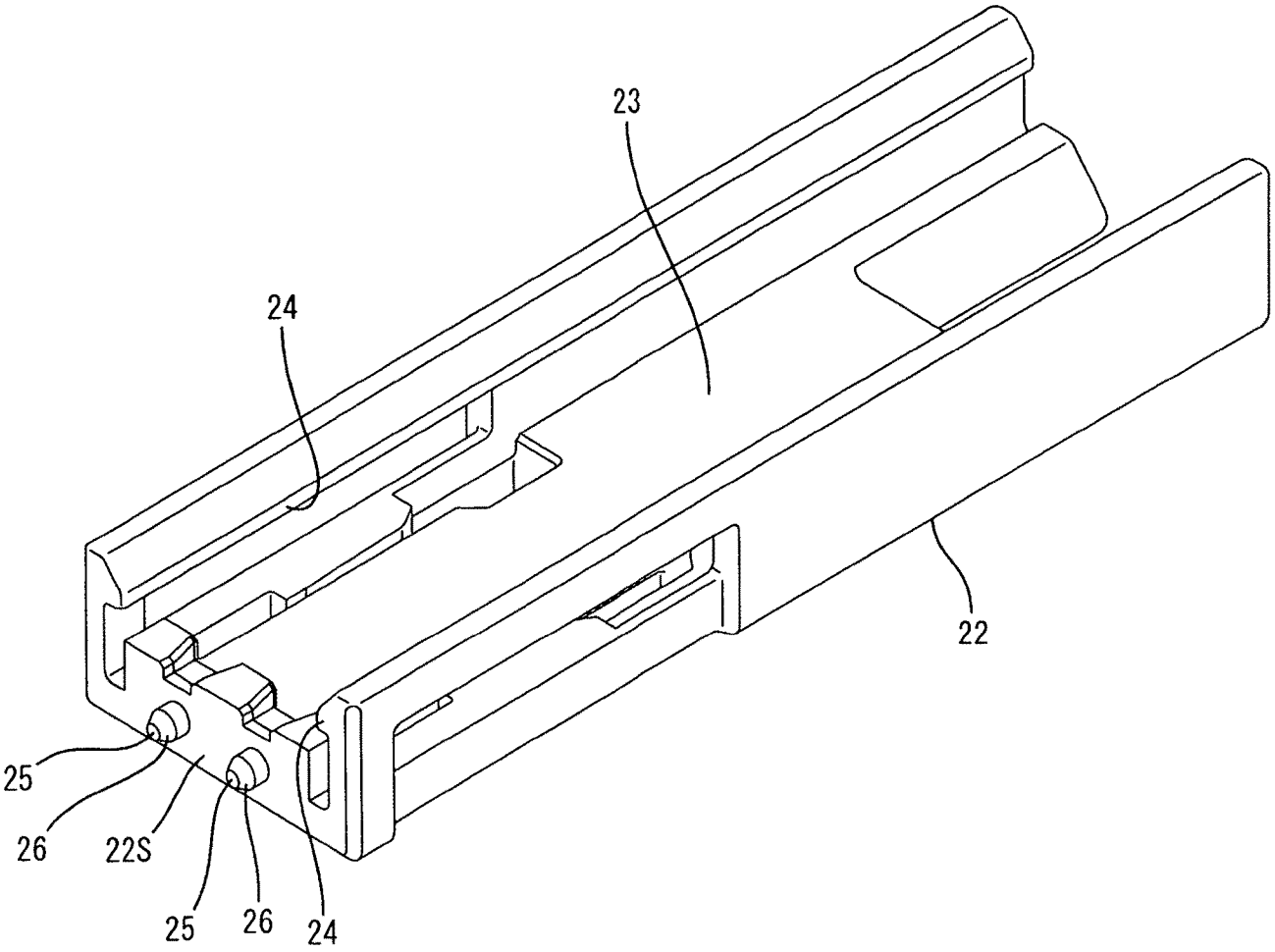
FIG. 5 is a perspective view of a slide member.

The male-side connector M includes a male-side housing 10 made of synthetic resin, a male-side dielectric body 16 mounted in the male-side housing 10, and a male internal conductor 30 attached to the male-side dielectric body 16. As shown in FIGS. 1 to 3, the male-side housing 10 is a single component having an accommodating portion 11 and a hood portion 12 extending forward in an angular tube shape from a front end of the accommodating portion 11. In the accommodating portion 11, an accommodating chamber 13 is formed so as to penetrate in the front-rear direction. As shown in FIG. 3, an upper surface of the accommodating chamber 13 is formed with a lance 14 extending forward in a cantilever manner which is elastically flexible and a front stopping portion 15 disposed behind the lance 14.

The male-side dielectric body 16 is constituted by vertically combining a holding member 17 made of synthetic resin and a slide member 22 also made of synthetic resin. The holding member 17 has a rectangular shape which is long in the front-rear direction in plan view. On the upper surface of the holding member 17, a retaining projection 18 is formed at a front-end side position, and a butt portion 19 is formed at a rear-end side position. The lower surface of the holding member 17 is formed with a pair of left and right locking portions 20. At the left and right side edge portions of the holding member 17, a pair of left and right symmetrical guide grooves 21 is formed.

The slide member 22 is has a rectangular shape which is long in the front-rear direction in plan view. The upper surface of the slide member 22 serves as a flat mounting surface 23 on which a male internal conductor 30, which will be described later, is mounted so as to be slidable in the front-rear direction. The slide member 22 has a pair of left and right symmetrical side walls formed at its left and right side edges, and upper end portions of the left and right side walls are formed with a pair of left and right symmetrical guide ribs 24 protruding inward in the left-right direction (width direction).

The slide member 22 is combined with the holding member 17 in such a positional relationship as to face the lower surface of the holding member 17, whereby the male-side dielectric body 16 is constituted. When assembling the holding member 17 and the slide member 22, the guide ribs 24 of the slide member 22 are fitted to the guide grooves 21 of the holding member 17 and are displaced relatively in the front-rear direction. In a state where the holding member 17 and the slide member 22 are assembled, the slide member 22 is movable relative to the holding member 17 in the front-rear direction between a protective position (see FIGS. 3 and 10) and a retracted position (see FIG. 12) behind the protective position. When the slide member 22 is in the protective position, a front surface 22S of the slide member 22 is located ahead of a front surface 17S of the holding member 17. When the slide member 22 is in the retracted position, the front surface 22S of the slide member 22 is located so as to be flush with the front surface 17S of the holding member 17.

On the front surface 22S of the slide member 22 (the surface facing the female-side connector F when the male-side connector M and the female-side connector F are fitted together), a pair of left and right symmetrical male-side positioning portions 25 is formed. Each of the male-side positioning portions 25 has a circular shape in a front view, and protrudes forward from the front surface 22S of the slide member 22. The male-side positioning portion 25 having a protruding shape includes a front end portion formed with a tapered surface 26 which is inclined such that a diameter thereof is reduced toward the front.

Figure 6:
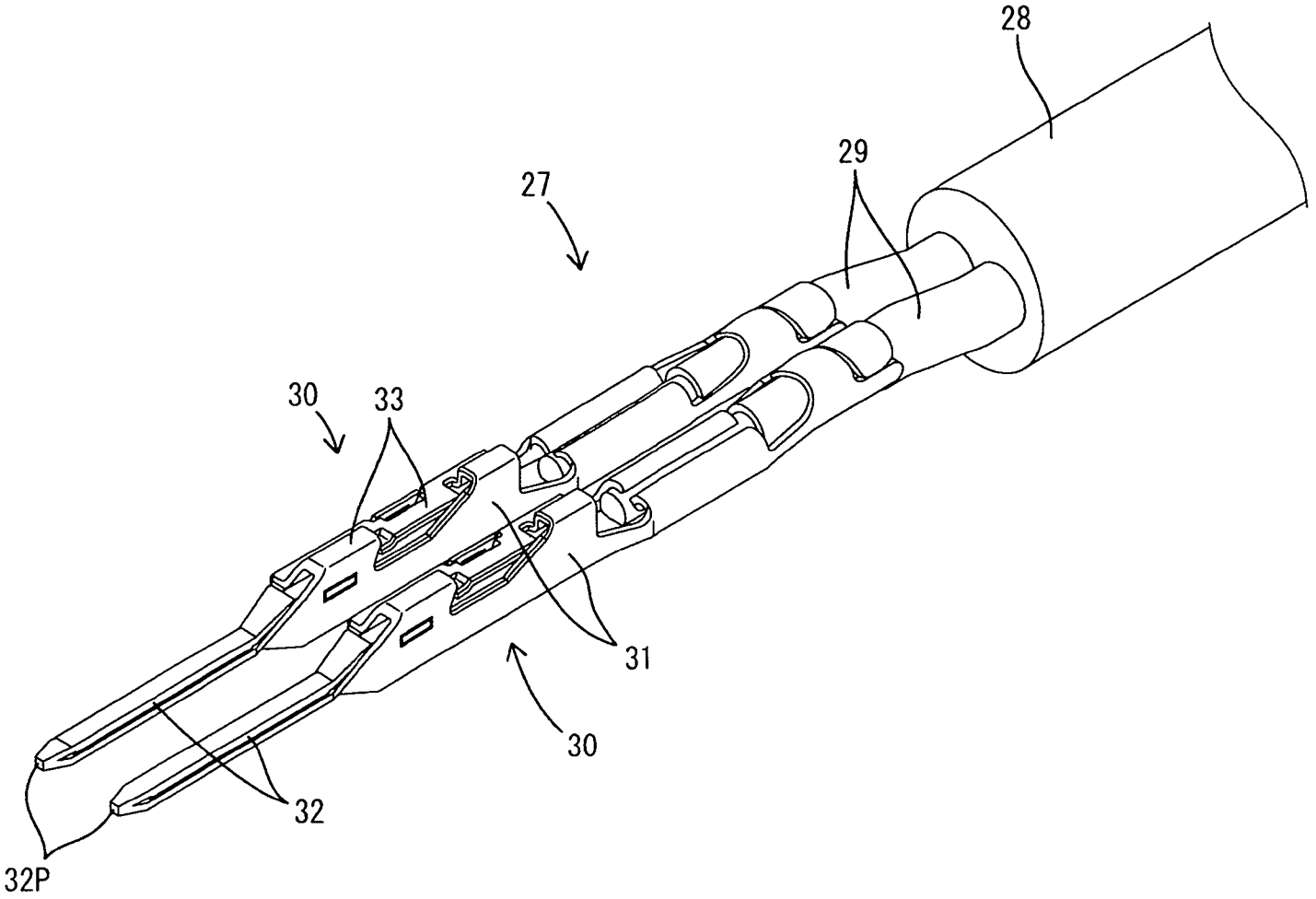
FIG. 6 is a perspective view of a conductive path.
Figure 7:
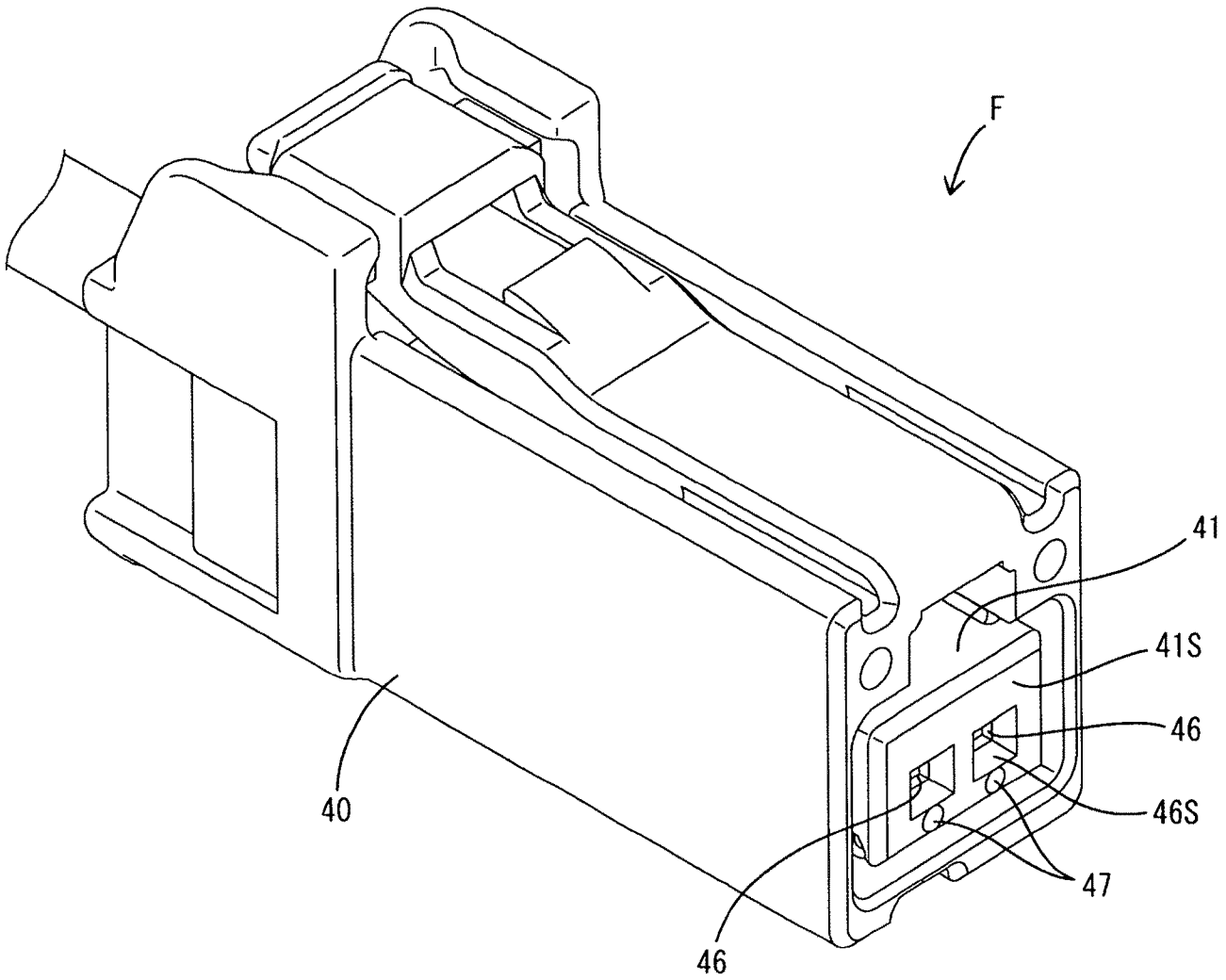
FIG. 7 is a perspective view of a female-side connector.
Figure 8:
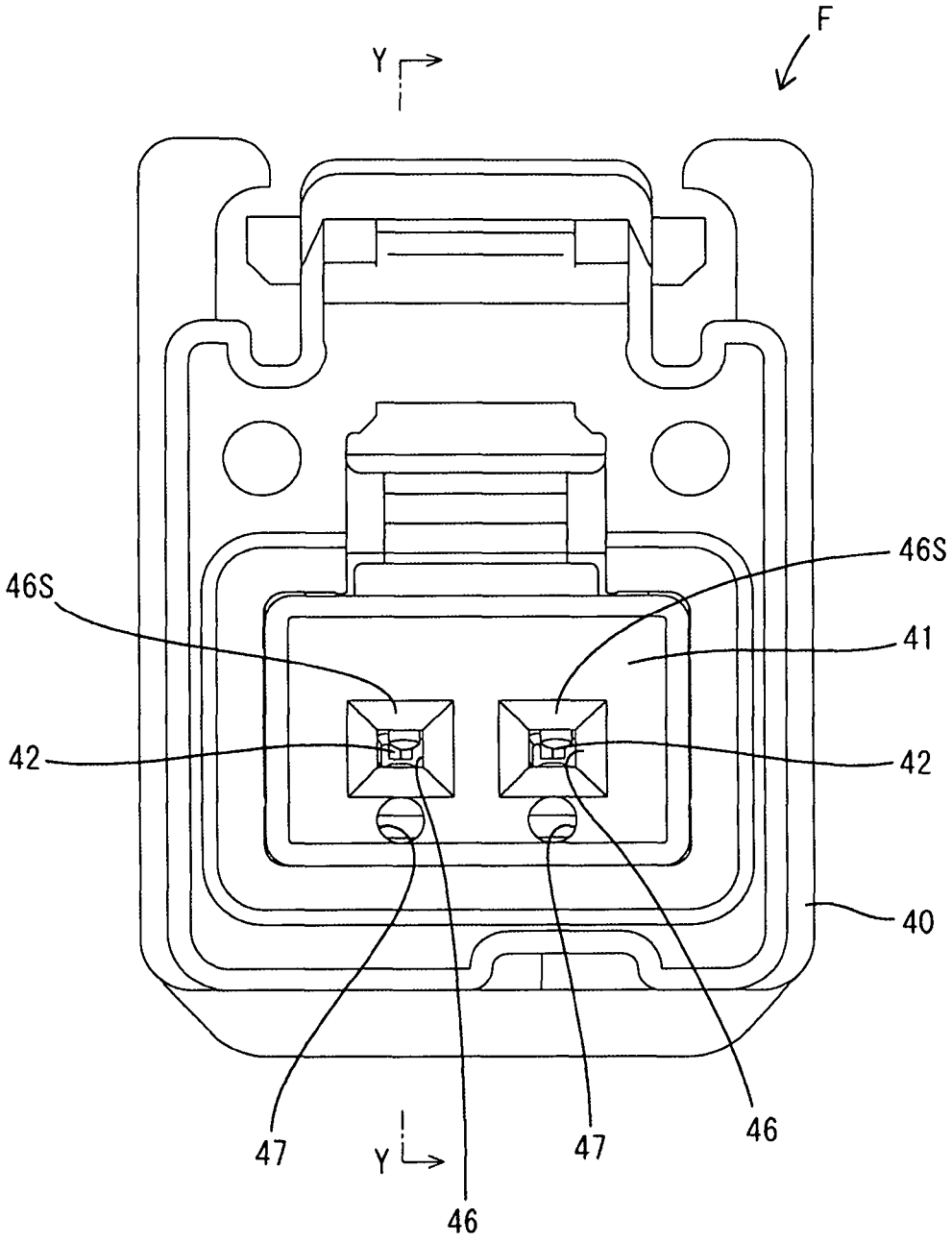
FIG. 8 is a front view of the female-side connector.

As shown in FIG. 6, the male-side conductive path 27 includes two wires 29 surrounded by a sheath 28 thereby constituting a twisted-pair cable, and a pair of the male internal conductors 30 secured to the respective front end portions of the wires 29 which are exposed by removing the sheath 28. Each male internal conductor 30 includes a main body 31 secured to the wire 29 and a tab 32 protruding forward from a front end of the main body 31 in a cantilever manner. The upper surface of the main body 31 is formed with an uneven portion 33. The tab 32 has a height dimension and a width dimension both smaller than those of the main body 31 and has an elongated shape as a whole.

The male internal conductor 30 is attached to the male-side dielectric body 16 with the main body 31 being mounted on the mounting surface 23 of the slide member 22 and the uneven portion 33 being locked to the locking portion 20 of the holding member 17. The male internal conductor 30 is held in a state where relative displacement in the front-rear direction with respect to the holding member 17 is restricted by the locking of the uneven portion 33 and the locking portion 20. Meanwhile, the male internal conductor 30 can be displaced in the front-rear direction relative to the slide member 22 in such a manner that a lower surface of the main body 31 and the mounting surface 23 are brought into sliding contact with each other.

When the slide member 22 is in the retracted position, the front surface 17S of the holding member 17 and the front surface 22S of the slide member 22 are both located behind a front end 32P of the tab 32 and a rear end of the tab 32. That is, when the slide member 22 is in the retracted position, the tab 32 protrudes ahead of the front surface 17S of the holding member 17 and the front surface 22S of the slide member 22 in a cantilever manner. When the slide member 22 is in the protective position, the front surface 22S of the slide member 22 is located ahead of the front end of the tab 32.

The male-side dielectric body 16 is inserted into the accommodating chamber 13 from the rear of the male-side housing 10 and thereby accommodated therein. In the state where the male-side dielectric body 16 is accommodated in the accommodating chamber 13, the retaining projection 18 is locked to the lance 14 and, the butt portion 19 is caused to abut against the front stopping portion 15, whereby the holding member 17 is fixed in a state where the relative displacement of the holding member 17 with respect to the male-side housing 10 in the front-rear direction is restricted.

The slide member 22 is displaceable relative to the accommodating chamber 13 (male-side housing 10) in the front-rear direction.

The female-side connector F includes a female-side housing 40 made of synthetic resin, a female-side dielectric body 41 mounted in the female-side housing 40, and a female internal conductor 42 attached to the female-side dielectric body 41. The female-side dielectric body 41 is made of synthetic resin and accommodated in the female-side housing 40 in a fixed state.

Similar to the male-side conductive path 27, the female-side conductive path 43 includes two wires 45 surrounded by a sheath 44 thereby constituting a twisted-pair cable, and a pair of the female internal conductors 42 secured to the respective front end portions of the wires 45 which are exposed by removing the sheath 44. The pair of female internal conductors 42 is accommodated in the female-side dielectric body 41 in a state where relative displacement is restricted.

A front surface 41S of the female-side dielectric body 41 is formed with a pair of left and right insertion openings 46 for inserting the tab 32 into the female internal conductor 42. The front surface 41S of the female-side dielectric body 41 is also formed with a pair of left and right female-side positioning portions 47. The female-side positioning portions 47 have such a form that the front surface 41S of the female-side dielectric body 41 is recessed in a hole shape, and are arranged immediately below the pair of left and right insertion openings 46. The female-side positioning portion 47 has a circular shape in a front view, and an inner diameter of the female-side positioning portion 47 is set to the same dimension as an outer diameter of the male-side positioning portion 25.

Figure 10:
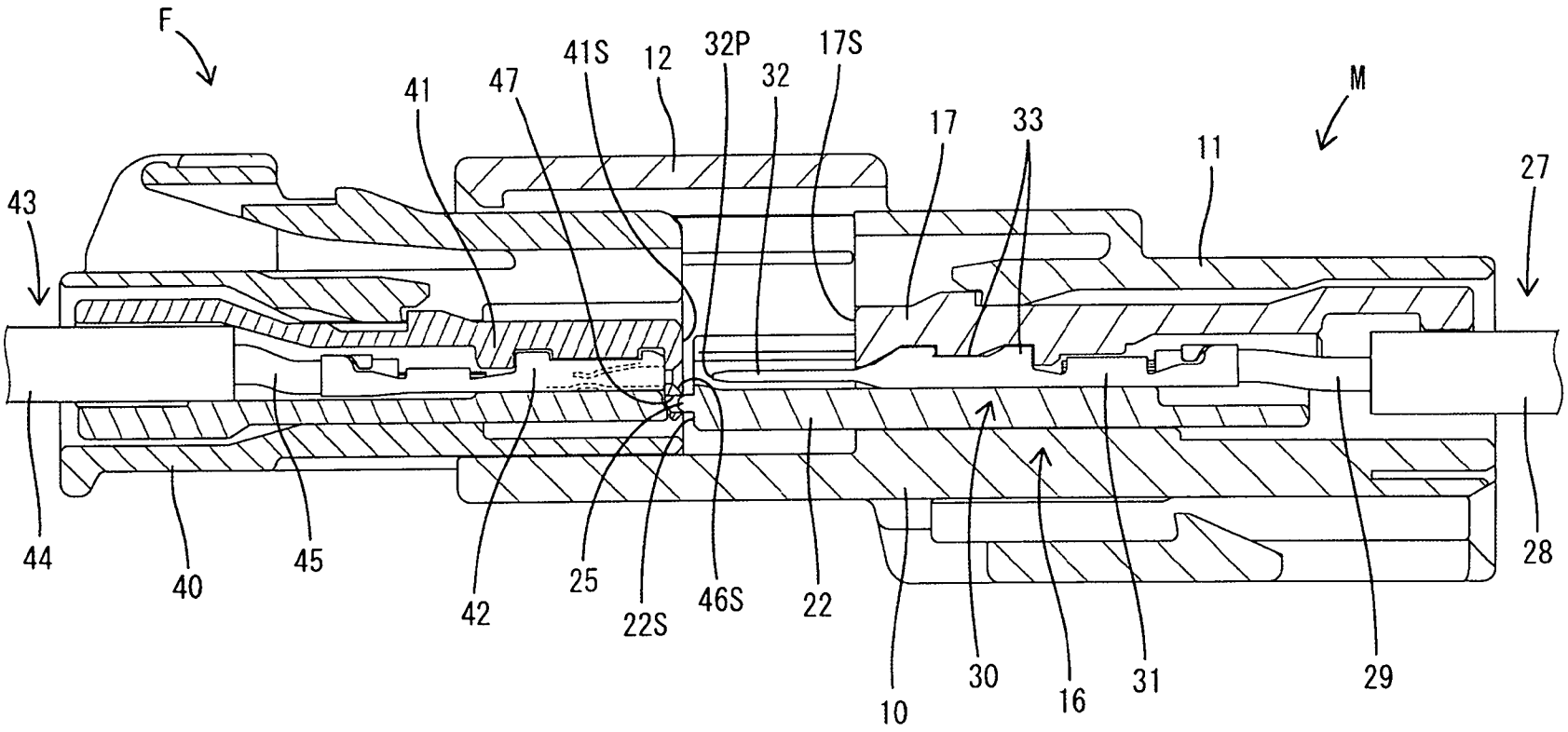
FIG. 10 is a side cross-sectional view showing a state in which fitting of the male-side connector and the female-side connector is started.
Figure 11:
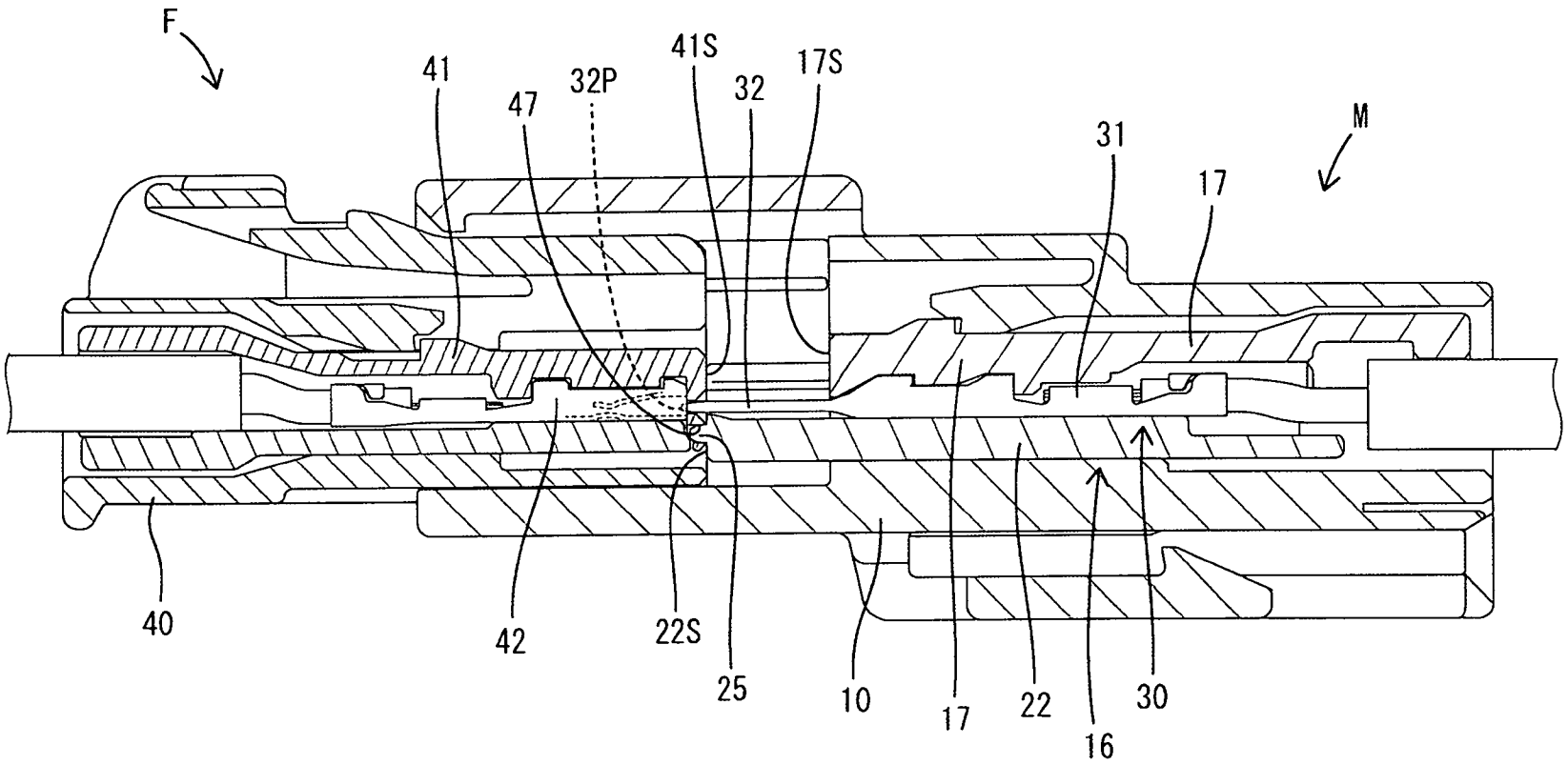
FIG. 11 is a side cross-sectional view showing a state in which a male-side positioning portion and a female-side positioning portion are fitted together in a process of fitting the male-side connector and the female-side connector.
Figure 12:
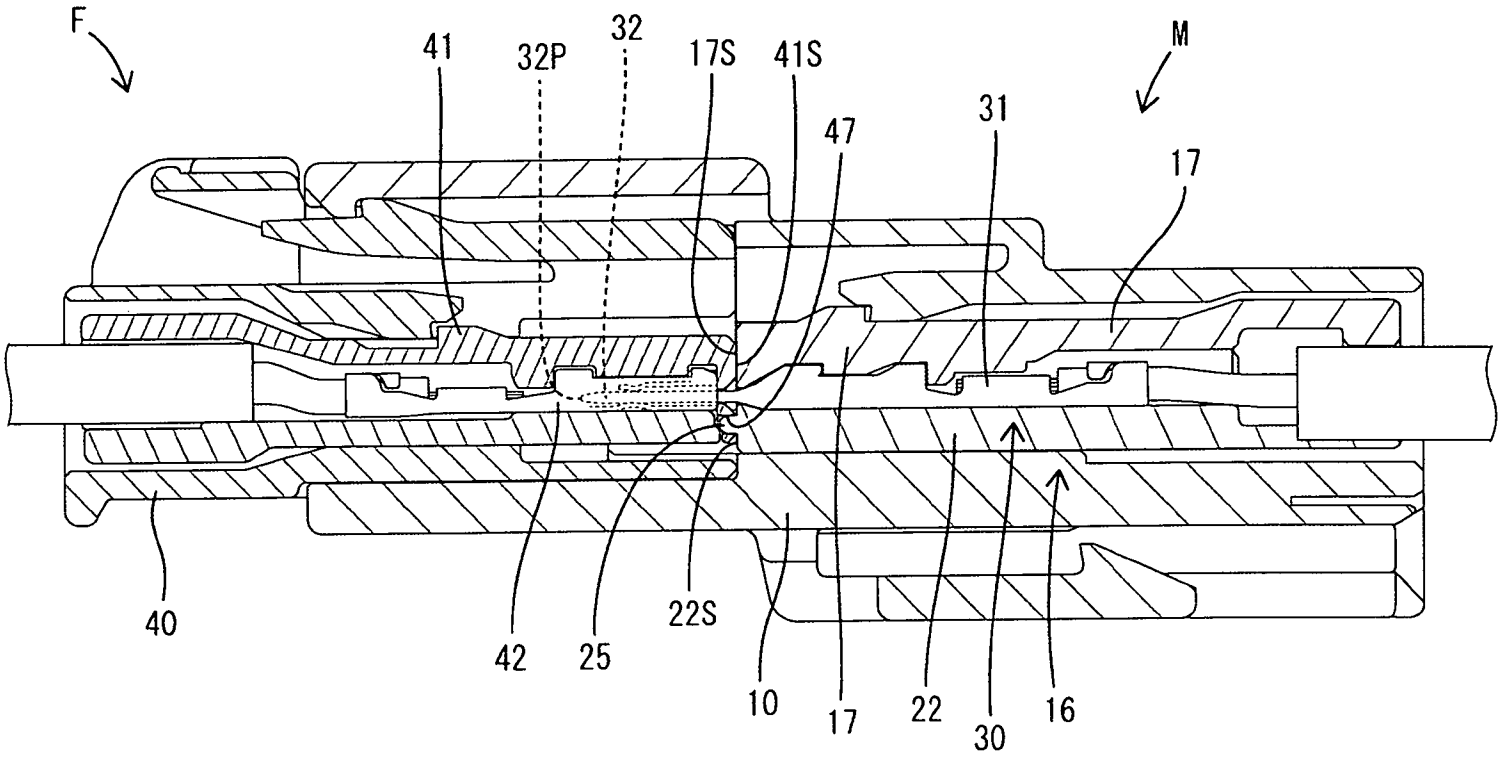
FIG. 12 is a side cross-sectional view showing a state in which fitting of the male-side connector and the female-side connector is completed.

When fitting the male-side connector M and the female-side connector F together, the slide member 22 of the male-side dielectric body 16 is moved to the protective position, and in this state, the hood portion 12 is fitted onto the female-side connector F (female-side housing 40), as shown in FIG. 10. As the fitting of both connectors F and M is advanced from the state of FIG. 10, the pair of male-side positioning portions 25 is fitted in the pair of female-side positioning portions 47, as shown in FIG. 11, and the front surface 22S of the slide member 22 abuts against the front surface 41S of the female-side dielectric body 41.

When the male-side positioning portion 25 and the female-side positioning portion 47 have been fitted together, the front end 32P of the tab 32 is located behind the front surface 22S of the slide member 22, so that the tab 32 is not in contact with the female-side dielectric body 41 and the female internal conductor 42. When the fitting of both the connectors F and M is advanced further from the state of FIG. 11, the slide member 22 is maintained in the state where it abuts against the front surface 41S of the female-side dielectric body 41, whereas the holding member 17 is moved integrally with the male-side housing 10 so as to approach the female-side dielectric body 41.

Here, due to the fitting of the male-side positioning portion 25 and the female-side positioning portion 47, the slide member 22 is prevented from being displaced in the up-down direction and in the left-right direction with respect to the female-side dielectric body 41 and the pair of female internal conductors 42. Further, wherever the slide member 22 is located between the protective position and the retracted position, the holding member 17 and the slide member 22 are prevented from being relatively displaced in the up-down direction and in the left-right direction, and the pair of male internal conductors 30 and the holding member 17 are prevented from being relatively displaced in the up-down direction and in the left-right direction.

Thus, the pair of male internal conductors 30 is positioned with respect to the female-side housing 40 and the pair of female internal conductors 42 so as to have a proper positional relationship in the up-down direction and in the left-right direction. The up-down direction and the left-right direction are both perpendicular to the front-rear direction in which the female-side and male-side dielectric bodies 16 and 41 approach each other and the male internal conductor 30 and the female internal conductor 42 are connected in the process of fitting both connectors F and M.

Therefore, when the fitting of both the connectors F and M is advanced from the state shown in FIG. 11, the pair of male internal conductors 30 approaches the female-side dielectric body 41 integrally with the holding member 17, and the tabs 32 enter the female-side dielectric body 41 from the respective insertion openings 46 thereby to be conductively connected with the respective female internal conductors 42. At this time, since the pair of male internal conductors 30 is positioned with respect to the female-side housing 40 by the fitting of the male-side positioning portions 25 and the female-side positioning portions 47, the tab 32 never abuts against the front surface 41S (a guide surface 46S in a peripheral edge of the insertion opening 46) of the female-side dielectric body 41.

The connector of the present embodiment includes the male-side dielectric body 16, the male internal conductor 30 provided in the male-side dielectric body 16 and having the tab 32 formed at the front end portion thereof, the female-side dielectric body 41 disposed so as to face the male-side dielectric body 16, and the female internal conductor 42 provided in the female-side dielectric body 41. When the male-side dielectric body 16 and the female-side dielectric body 41 approach each other in an opposing positional relationship, the tab 32 is inserted into the female-side dielectric body 41 and connected to the female internal conductor 42.

The female-side dielectric body 41 has the opposing surface (front surface 41S) facing the male-side dielectric body 16 and formed with the female-side positioning portion 47, and the male-side dielectric body 16 has the opposing surface (front surface 22S) facing the female-side dielectric body 41 and formed with the male-side positioning portion 25 which is fitted with the female-side positioning portion 47 in a state where the male-side positioning portion 25 is disposed ahead of the tab 32 and the tab 32 is not in contact with the female-side dielectric body 41. According to this configuration, when the male-side dielectric body 16 and the female-side dielectric body 41 are caused to approach each other, the male-side positioning portion 25 and the female-side positioning portion 47 are fitted together, and thereby the male-side dielectric body 16 and the tab 32 are positioned relative to the female-side dielectric body 41 and the female internal conductor 42, with the result that the tab 32 is reliably connected to the female internal conductor 42 without interfering with the female-side dielectric body 41.

In the connector of the present embodiment, the male-side dielectric body 16 includes the holding member 17 for holding the region (main body 31) behind the tab 32 of the male internal conductor 30, and the slide member 22 which is slidable with respect to the holding member 17 in the front-rear direction between the protective position and the retracted position behind the protective position. The female-side positioning portion 47 is formed on the opposing surface (front surface 41S) of the female-side dielectric body 41 facing the slide member 22, and the male-side positioning portion 25 is formed on the opposing surface (front surface 22S) of the slide member 22 facing the female-side dielectric body 41. The male-side positioning portion 25 and the female-side positioning portion 47 are fitted with each other with the slide member 22 being in the protective position and the tab 32 being not in contact with the female-side dielectric body 41.

According to the above configuration, when the male-side dielectric body 16 and the female-side dielectric body 41 are caused to approach each other while the slide member 22 is in the protective position, the male-side positioning portion 25 and the female-side positioning portion 47 are fitted together, and thereby the male-side dielectric body 16 and the tab 32 are positioned relative to the female-side dielectric body 41 and the female internal conductor 42. In this state, when the male-side dielectric body 16 is caused to further approach the female-side dielectric body 41, the holding member 17 and the male internal conductor 30 approach the female-side dielectric body 41 while being displaced relative to the slide member 22, and the tab 32 is reliably connected to the female internal conductor 42 without interfering with the female-side dielectric body 41.

The male-side positioning portion 25 has a protruding shape, and the female-side positioning portion 47 has a recessed shape. The male-side positioning portion 25 having a protruding shape includes a tapered surface 26. According to this configuration, it is possible to fit the protruding male-side positioning portion 25 and the female-side positioning portion 47 smoothly by the tapered surface 26. Further, the male-side positioning portion 25 has a protruding shape, the female-side positioning portion 47 has a recessed shape, and the male-side dielectric body 16 formed with the male-side positioning portion 25 is accommodated in the male-side housing 10 having the hood portion 12 surrounding the tab 32. According to this configuration, the male-side positioning portion 25 having a protruding shape can be protected from interference of foreign matter by being accommodated in the hood portion 12.

Other Embodiments

The present invention is not limited to the above embodiment, which has been described using the foregoing description and the drawings, and, for example, embodiments as described below are also encompassed within the technical scope of the present invention.

(1) In the above embodiment, the male-side positioning portion has a protruding shape and the female-side positioning portion has a recessed shape; however, conversely, the male-side positioning portion may have a recessed shape, the female-side positioning portion may have a protruding shape.

(2) In the above embodiment, although the male-side positioning portion having a protruding shape includes the tapered surface, the male-side positioning portion having a protruding shape may have no tapered surface.

(3) In the above embodiment, although the tapered surface is formed in only the protruding positioning portion (male-side positioning portion), the tapered surface may be formed in both of the protruding positioning portion (male-side positioning portion) and the recessed positioning portion (female-side positioning portion), or may be formed in only the recessed positioning portion (female-side positioning portion).

(4) Although a pair of male-side positioning portions and a pair of female-side positioning portions are provided in the above embodiment, the number of the male-side positioning portion and the female-side positioning portion may be one, or may be three or more, respectively.

(5) In the above embodiment, although the male-side dielectric body includes the holding member and the slide member which is slidable with respect to the holding member in the front-rear direction between the protective position and the retracted position, the male-side dielectric body may be a single component in which the male-side positioning portion protrudes ahead of the tab.

REFERENCE SIGNS LIST

10 male-side housing
12 hood portion
16 male-side dielectric body
17 holding member
22 slide member
25 male-side positioning portion
26 tapered surface
30 male internal conductor
32 tab
41 female-side dielectric body
42 female internal conductor
47 female-side positioning portion

The invention claimed is:

1. A connector comprising:

a male-side dielectric body;

a male internal conductor provided in the male-side dielectric body and having a tab extending forward from a main body thereof in a cantilever manner;

a female-side dielectric body disposed so as to face the male-side dielectric body; and a female internal conductor provided in the female-side dielectric body, wherein when the male-side dielectric body and the female-side dielectric body approach each other in an opposing positional relationship in a front-rear direction, the tab is inserted into the female-side dielectric body and connected to the female internal conductor, the male-side dielectric body includes a holding member for holding the main body and a slide member, the holding member and the slide member are combined in a direction perpendicular to a direction in which the male-side dielectric body and the female-side dielectric body face and approach each other, the slide member is slidable with respect to the holding member in the front-rear direction, the female-side dielectric body has an opposing surface facing the slide member body and formed with a female-side positioning portion, and the slide member has an opposing surface facing the female-side dielectric body and formed with a male-side positioning portion which is disposed ahead of the tab and which can be fitted with the female-side positioning portion in a state where the tab is not in contact with the female-side dielectric body.

2. The connector according to claim 1, wherein slide member is slidable with respect to the holding member in a front-rear direction between a protective position and a retracted position behind the protective position, and when the slide member is in the protective position, a front surface of the slide member is located ahead of a front end of the tab.

3. The connector according to claim 2, wherein
one of the male-side positioning portion and the female-side positioning portion has a protruding shape,
the other positioning portion has a recessed shape, and
at least one of the positioning portion having a protruding shape and the positioning portion having a recessed shape may include a tapered surface.

4. The connector according to claim 3, wherein
the male-side dielectric body is accommodated in a male-side housing having a hood portion surrounding the tab,
the male-side positioning portion has a protruding shape, and
the female-side positioning portion has a recessed shape.

5. The connector according to claim 1, wherein
one of the male-side positioning portion and the female-side positioning portion has a protruding shape,
the other positioning portion has a recessed shape, and
at least one of the positioning portion having a protruding shape and the positioning portion having a recessed shape may include a tapered surface.

6. The connector according to claim 1, wherein
the male-side dielectric body is accommodated in a male-side housing having a hood portion surrounding the tab,
the male-side positioning portion has a protruding shape, and
the female-side positioning portion has a recessed shape.

* * * * *